United States Patent [19]

Henn et al.

[11] Patent Number: 4,790,689

[45] Date of Patent: Dec. 13, 1988

[54] METHOD AND APPARATUS FOR PRODUCING A SUPPORT ELEMENT IN THE GROUND

[75] Inventors: Günter Henn; Manfred Stocker, both of Schrobenhausen; Erwin Stötzer, Aichach; Konrad Friedrich; Thomas Bauer, both of Schrobenhausen, all of Fed. Rep. of Germany

[73] Assignee: Bauer Spezialtiefbau GmbH, Schrobenhausen, Fed. Rep. of Germany

[21] Appl. No.: 74,741

[22] Filed: Jul. 17, 1987

[30] Foreign Application Priority Data

Jul. 17, 1986 [DE] Fed. Rep. of Germany ..... 3624202

[51] Int. Cl.[4] ..... E02D 5/34

[52] U.S. Cl. ..... 405/240; 405/231; 405/233

[58] Field of Search ..... 405/239, 241, 242, 243, 405/237, 238, 231, 232

[56] References Cited

U.S. PATENT DOCUMENTS

| | | | |
|---|---|---|---|
| 2,920,455 | 1/1960 | Ryser et al. | 405/239 X |
| 3,130,552 | 4/1964 | Bodine | 405/266 |
| 3,200,599 | 8/1965 | Phares et al. | 405/239 X |
| 3,512,366 | 5/1970 | Turzillo | 405/239 X |
| 3,675,428 | 7/1972 | Watts | 405/129 |
| 3,690,109 | 9/1972 | Torzillo | 405/241 |

FOREIGN PATENT DOCUMENTS

| | | | |
|---|---|---|---|
| 65615 | 7/1914 | Austria | 405/241 |
| 2428870 | 1/1975 | Fed. Rep. of Germany | 405/241 |
| 0036592 | 3/1980 | Japan | 405/241 |
| 1026094 | 4/1966 | United Kingdom | 405/241 |

*Primary Examiner*—Dennis L. Taylor

*Attorney, Agent, or Firm*—Fleit, Jacobson, Cohn & Price

[57] ABSTRACT

A method and an apparatus for producing a support element in the ground are described, a hole being sunk through non-stable ground at least down to the load bearing soil. As a result of a wedge-shaped construction of the drill bit the loosened soil is displaced into the adjacent region of the hole and consequently the area round the hole is compacted. The drill has a circular cylindrical core, which is provided with an outlet opening in the vicinity of the drill bit. Preferably tampable material is filled through the core tube, accompanied by the retraction of the drill. The material is simultaneously tamped with the aid of the drill. The invention has the particular advantage that, in cost effective manner, it is possible to use tampable material from the area immediately surrounding the building site and there is no need for expensive, classified filling material. Tubing of the hole is unnecessary through the use of the core tube.

15 Claims, 2 Drawing Sheets

METHOD AND APPARATUS FOR PRODUCING A SUPPORT ELEMENT IN THE GROUND

BACKGROUND OF THE INVENTION

The present invention relates to a method for producing support elements in the ground, in which a hole is sunk through non-stable ground at least to load bearing ground and filled with a load bearing material. The invention also relates to an apparatus with a twist drill for performing the method.

It is necessary to have support elements in the ground, where structures cause loads in the ground which cannot be borne by the naturally occurring soil. The introduced support elements, which pass either down to the load bearing ground or into the latter, bridge the not stable soil and constitute a connecting member between the structure and the fixed geology. The structure can be constituted both by traffic links and buildings.

For example in connection with road building, it is known to completely remove the non-load bearing soil and replace it by load bearing material. In addition, support elements are used, which comprise bored piles or piling poles which, as a function of their number and diameter, extend onto the load bearing soil or are bound in the latter. Moreover a soil improvement or replacement method is used, in which the not load bearing soil is tamped by vibration and in this way is transformed into a stable subsoil. A further consolidation can be achieved in this way by adding ballast. If the tamping of the soil is carried out without a prior drilled hole, into which the material to be tamped is filled, a foundation of the support element on the load bearing soil can still be achieved. However, under these conditions, in many cases the desired and required supporting effect cannot be achieved. This disadvantage also appears in another method, in which the non-load bearing soil is improved or replaced by chemical injection, e.g. a high pressure cement injection.

Thus, in the known methods, openings are normally made through the non-load bearing ground and, following this, the support elements are introduced. In most cases these openings must be tubed, which leads to high labour expenditure.

SUMMARY OF THE INVENTION

The problem of the present invention is to provide a method of the aforementioned type, which can be less expensively performed. In addition, the problem, of the invention is to provide an apparatus for performing this method.

From the method standpoint, this problem is solved in that on sinking a twist drill having a web or core tube for soil tamping purposes, the drilled material is displaced radially outwards into the surrounding soil by means of a wedge-like drill tip or bit, the core tube is used for supplying support material and the hole is filled by means of an outlet opening in the core tube whilst retracting the latter.

From the apparatus standpoint, the problem is solved in that the twist drill has a circular cylindrical core tube with an outlet opening located at the end thereof, a wedge surface arranged on an approximately cylindrical horseshoe-shaped chamfer of the core tube is present at the core tube end, that the wedge surface-free cross-section of the core tube is kept free as an outlet opening, that a radially directed cutting edge is provided, which is at a maximum right angle to the core tube axis and arranged below the wedge surface, the maximum radius of said cutting edge corresponding to the twist drill maximum radius.

The basic principle of the invention is that for producing a support a drill is sunk and a considerable part of the soil loosened with the cutting edge is displaced by means of the chamfered tip into the adjacent hole region and consequently the building geological circumstances are improved. As there is also an outlet opening, the drill can also be used for filling the hole, without separate tubing having to be placed in the hole. This ensures a rapid advance of the building work compared with conventional methods. Due to the consolidation of the adjacent soil, the stability and loadability of the finished supports are significantly improved.

The opening of the soil can essentially take place without any soil extraction, there being no need to transport upwards lower lying soil layers. This can be desirable for environmental reasons, e.g. if peat is incorporated into the non-load bearing soil, or if e.g. supports must be installed in previous dust holes.

According to a preferred development of the inventive method, the support material is tamped during filling accompanied by a reverse rotation of the twist drill. This measure has the advantage that any available tamperable material can be filled, which can be taken from the area close to the building site without involving high transportation costs. In addition, the material costs are low. There is consequently no need to use expensive, classified material, which is not generally locally available and must therefore be brought in from remote points involving high transportation costs. Thus, valuable raw materials and energy are saved and the obviating of the transportation of material is advantageous for the embodiment.

It can also be advantageous to arrange in the support material an upwardly leading profiled support element supported on the bottom of the hole, the profiled support element being led out of the outlet opening of the core tube. Preferably, the profiled support element comprises a double T girder.

A further reinforcement of the columnar support element can be achieved in that the profiled support element is given a reinforcement.

A further development of the apparatus consists of providing the wedge surface with a radially directed free leading edge in the projection.

The arrangement is preferably further developed in that the projection of the wedge surface is spiral. This shape is particularly advantageous for the radial displacement of the loosened soil.

A further preferred development of the apparatus consists of the rear part of the cutting edge passing into a conveying spiral.

It can also be advantageous to arrange cutting teeth on the cutting edge.

The load bearing characteristics of the filled material and the surrounding hole area can be improved in that the cutting edge is arranged at an angle to the core tube axis, which is smaller than 90°. Thus, during a vibratory movement of the drill, not only is a vertical pressure exerted, but a horizontal component acts as a result of the chamfer.

It is particularly advantageous for the end of the wedge face and/or the core tube to be spirally chamfered and for at least one vertical cutting tooth to be placed on the same. These measures not only improve the drilling efficiency, but serve to stabilize the drill on starting.

It is also advantageous to provide the cutting edge with a pitch and to pass into the conveying spiral.

It is also advantageous for the stability and robustness of the apparatus, that the leading edges of the cutting edge and wedge face intersect on the core tube axis.

Thus, the invention is characterized in that support elements can be produced with low material and manufacturing costs, there being a significant reduction in the time required compared with conventional methods. The invention is also friendly to the environment, because there is no noise and no energy consumption during classification and the transportation of load bearing material.

BRIEF DESCRIPTION OF THE DRAWINGS

The invention is described in greater detail hereinafter relative to an embodiment and the attached drawings, where.

DETAILED DESCRIPTION OF THE INVENTION

Figure 1:
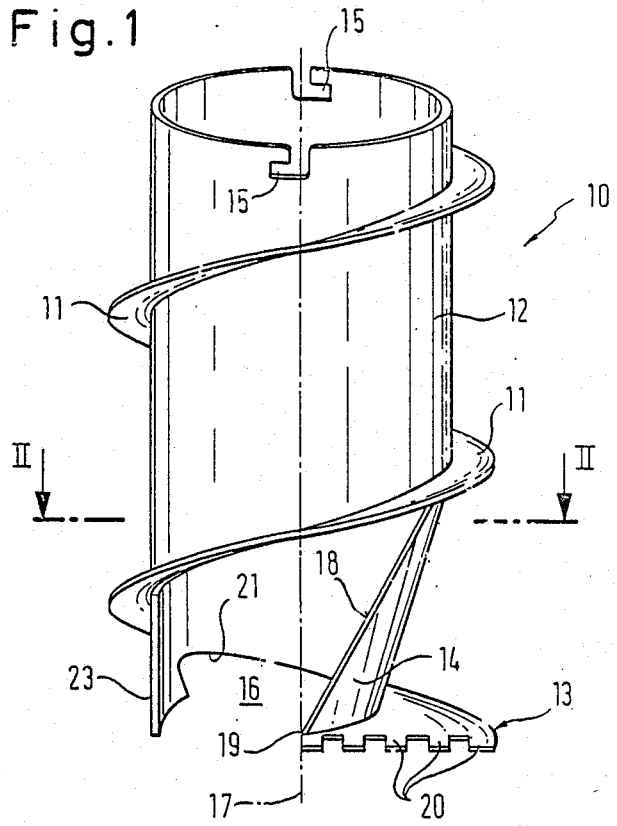
FIG. 1 shows a purely diagrammatically a perspective view of an apparatus for producing ground support elements.

In FIG. 1 the apparatus for producing the ground or soil support elements is designated 10. It comprises a twist drill with a circular cylindrical core tube 12, on whose cylinder jacket is fitted a conveying spiral 11. On the end of the core tube 12, i.e. on the drill bit is placed an inclined wedge surface 14 with, in projection, a radially directed, free leading edge 18. The latter extends from the core tube axis 17 on the drill bit to the core tube jacket. Wedge surface 14 in the presently shown embodiment passes in worm-shaped or helical manner with a funnel-shaped enlargement and its rear part merges into the core tube jacket. the front end of the wedge surface 14 and the core tube is helically chamfered. At its leading end, the core tube 12 also has an outlet opening 16, which essentially corresponds to the internal cross-section of core tube 12. The apparatus is also provided with a cutting edge 13, which in the present case is roughly perpendicular to the tube axis. It is provided with cutting teeth 20 on its lip located below the free edge 18 of the wedge surface. The free leading edge 18 of wedge surface 14 and the lip of cutting edge 13 are connected at a point 19 on the tube axis, so that they stabilize and support one another. The width of cutting edge 13 in projection precisely corresponds to the maximum radius of the conveying spiral 11. It should thus be clear that when the core tube 12 is rotated, cutting edge 13 will cover the entire cross-section of a hole formed by the twist drill. It is guided rearwards along wedge surface 14 and corresponding to the configuration of the latter passes into the conveying spiral 11 with a pitch corresponding to the latter.

In the presently shown embodiment, wedge surface 14 is attached directly below the conveying spiral, the lower end face 21 of the core tube and wedge surface 14 following the configuration of the conveying spiral 11 and cutting edge 13. A vertical cutting tooth 23 is constructed along the lower end face 21 and runs in the extension of the outer cylindrical surface of core tube 12. Thus, whilst the cutting edge 13 engages in roughly a horizontal direction, the vertical cutting tooth 23 acts along the wall of the hole. It is obvious that more than one further cutting tooth 23 can be arranged on the lower end face 21. Only one such cutting tooth 23 is shown in the drawing so as not to overburden the latter.

On the top of apparatus 10 is provided a high-speed coupling 15 for connecting the apparatus 10 to a drill pipe or the like (not shown).

Figure 2:
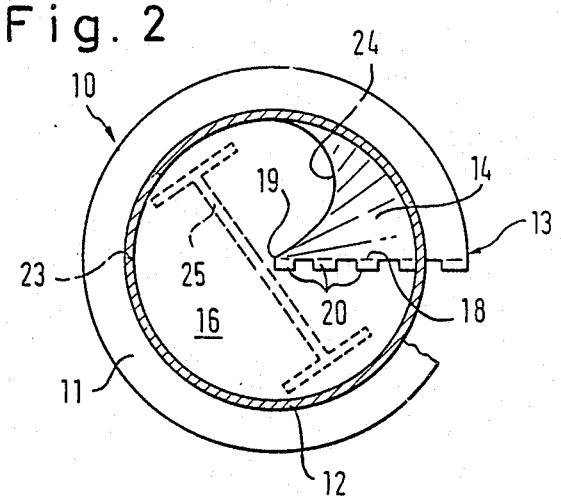
FIG. 2 shows a cross-section through the apparatus according to FIG. 1.

Section line II indicates the viewing direction for the cross-section shown in FIG. 2. FIG. 2 makes it clear that the lower edge of wedge surface 14 forms a spiral 24, which passes into the jacket circle, or hollow interior space, formed by the core tube 12. If the apparatus according to FIG. 2 is rotated clockwise, then the cutting edge 13 loosens the soil, cutting tooth 23 having a supporting action. As a result of the inclined wedge surface 14, the loosened soil is displaced into the surrounding area, soil grains being rearranged or transposed and due to tamping the area around the hole is converted into a more load bearing state. In the case of soil which cannot be readily transposed, there is at least a bracing effect, which also increases the load bearing characteristics. FIG. 2 also shows the outlet opening 16. Although obviously almost the entire cross-section of core tube 12 is opened, as a result of the arrangement of wedge surface 14 the complete drilled material is displaced to the outside, without drilling mud getting into the interior of the core tube 12.

FIG. 2 also shows the way in which a double T girder 25 is arranged in the interior of the core tube 12 and passes, without being mipeded by apparatus 10, through the outlet opening 16 and can be supported on the bottom of the hole. A further explanation thereof is provided in connection with FIG. 5. FIGS. 1 and 2 also show that in the case of a reverse rotation of apparatus 10, i.e. counterclockwise in the represented embodiment, a surface pressure can be exerted on the soil below by cutting edge 13, as well as by the conveying spiral 11 in the case of a downwardly directed movement of apparatus 10. The entire cross-section of the hole can be successively reached by the surface of cutting edge 13. In place of a constant vertical pressure, it is also possible to vibrate apparatus 10 or to achieve a ramming effect by an up and down movement.

The function of the apparatus and a method for producing a columnar support element will be described in greater detail hereinafter with respect to FIGS. 1 to 5.

Figure 3:
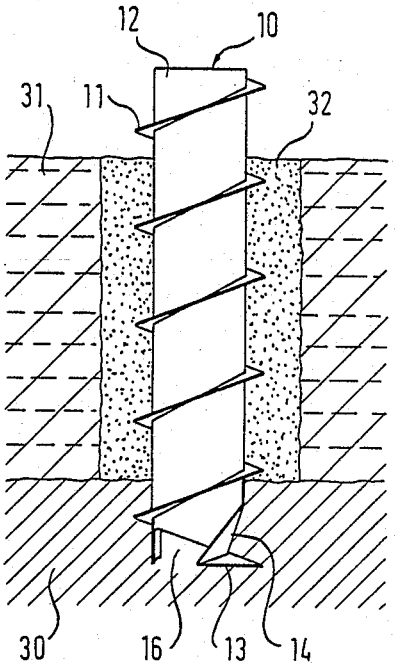
FIG. 3 shows diagrammatically the production of a support element with an apparatus according to FIG. 1.
Figure 4:
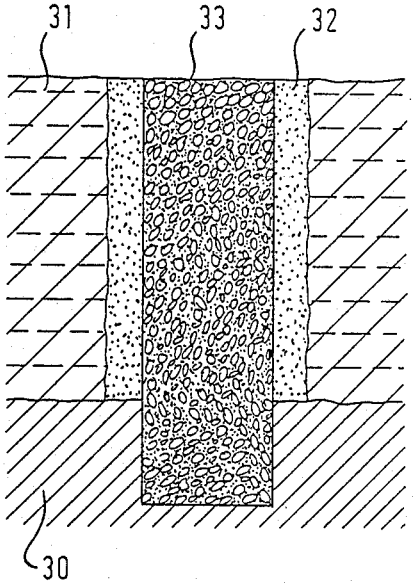
FIGS. 4 and 5 each show a cross-section or diagrammatical perspective view through a support element.
Figure 5:
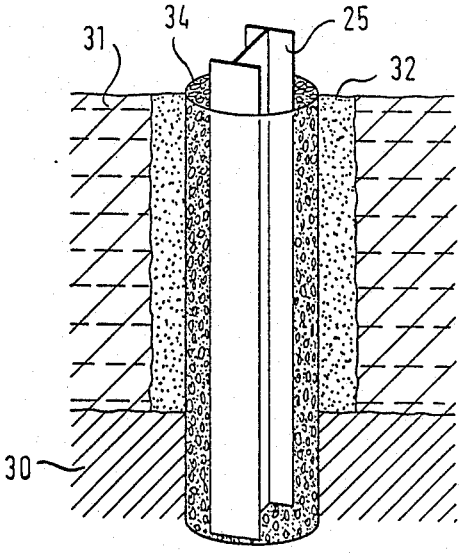

In a ground cross-section in FIGS. 3 to 5 a non-load bearing soil 31 is located above a load bearing soil 30. Using apparatus 10 a hole is sunk down to the load bearing soil. The soil loosened by apparatus 10 is displaced almost exclusively radially into the area round the hole without any significant upward transportation, so that a tamped or consolidated region 32 is produced. Displacement essentially takes place through wedge surface 14. Conveying spiral 11 inter alia has the function of preventing a jamming of core tube 12 in the hole and to keep moving drilling must, which could jam between the core tube 12 and the wall of the hole, or to remove said must out of the hole.

The displacement of the loosened material and the transfer into the consolidated region 32 can be reinforced by a vibrating action of apparatus 10 and by the shape of the conveying spiral.

After core tube 12 has been sunk to the desired depth, material is fed into said core tube for forming the support element. It is cheapest and simplest if use is made of consolidatable material, which is generally available in large quantities in the area around the building site. The material passes through outlet opening 16 onto the bottom of the hole and is tamped by the surface of cutting edge 13 accompanied by a reverse rotation of apparatus 10. The tamping or consolidating action is aided if the apparatus 10 is vibrated.

As a result of an inclination of the cutting edge surface, i.e. an arrangement at an angle to the longitudinal axis of the core tube which is smaller than 90°, a further consolidation of the area round the hole is achieved during this process, because the pressure is transferred outwards.

The quality of the consolidation can be checked and measured by an accelerometer, which is operatively connected to the apparatus 10.

By returning apparatus 10 to the surface of the ground in the manner described a columnar support element 33 is formed, as shown in cross-section in FIG. 4. Support element 33 is located in load bearing soil 30 and surrounded by the consolidated region 32.

It can be gathered from FIGS. 2 and 5 that, in addition to the filled material 35, in a continuous process a shaped steel or concrete section 25 is introduced into the hole and can be supported in the load bearing soil 30, without it being necessary for this purpose to remove apparatus 10 from the hole. Subsequently material 34 can be introduced into the core tube and consolidated in the aforementioned manner by vibration and vertical pressure. There is no reverse rotation of apparatus 10 during this process.

What is claimed is:

1. A method for producing a columnar support element in the ground, comprising the steps of:

providing a cylindrical core tube having a longitudinal axis, a hollow interior space and an outlet opening, the core tube having an inclined wedge surface extending into the hollow space of the core tube and a cutting edge extending perpendicularly to the axis at a lower end of the wedge surface;

sinking a hole through non-load bearing soil at least down to load bearing soil by rotating the core tube in a first direction and axially moving the cylindrical core tube so that the cutting edge cuts through non-load bearing soil;

simultaneously displacing said non-load bearing soil radially outward into an area surrounding said hole by said inclined wedge surface;

feeding support material into the hollow interior space of said cylindrical core tube;

retracting the cylindrical core tube from the hole so that the support material pours through said hollow interior space and through said outlet opening into said hole;

rotating the core tube in a second, opposite direction so that the cutting edge covers the entire cross-section of the hole; and tamping said support material into said hole during axial movement of the cylindrical core tube out of siad hole by means of said cutting edge.

2. A method as recited in claim 1, wherein the rotation in the second opposite direction of the core tube is accompanied by vibration.

3. A method for producing a columnar support element in the ground, comprising the steps of:

providing a cylindrical core tube having a longitudinal axis, a hollow interior space and an outlet opening, the core tube having an inclined wedge surface extending into the hollow interior space of the core tube and a cutting edge extending perpendicularly to the axis at a lower end of the wedge surface;

sinking a hole through non-load bearing soil at least down to load bearing soil by rotating the core tube in a first direction and axially moving the cylindrical core tube so that the cutting edge cuts through non-load bearing soil;

simultaneously displacing said non-load bearing soil radially outward into an area surrounding said hole by said inclined wedge surface;

feeding support material into the hollow interior space of said cylindrical core tube;

supporting an upwardly leading profiled support element through the outlet opening on the load bearing soil;

retracting the cylindrical core tube from the hole so that the support material pours through said hollow interior space and through said outlet opening into said hole; and tamping said support material into said hole during axial movement of the cylindrical core tube out of said hole by means of said cutting edge.

4. A method as recited in claim 3, and further comprising the steps of introducing a double T girder into the hole and through the outlet opening, and using the girder as the profiled support element.

5. A method as recited in claim 3, and further comprising the step of providing the profiled support element with a reinforcement.

6. A device for producing a columnar support element in the ground by producing a hole and filling it with support material, comprising:

a circular cylindrical core tube having a tub core axis, a core tube jacket and a lower end face;

an inclined wedge surface having a lower edge, the wedge surface being arranged on a chamfer at a free end of the core tube, the wedge surface extending inward into a jacket circle formed by the core tube so that the wedge surface occupies a portion of the cross-sectional area of the jacket circle, the lower edge of the wedge surface and the lower end face of the circular cylindrical core tube defining an outlet opening of the core tube, the wedge surface having, in axial projection, a radially directed free leading edge, the free leading edge extending from the core tube axis to the core tube jacket;

a funnel-shaped enlargement formed by the wedge surface and merging into said core tube jacket;

a cutting edge extending perpendicularly to the core tube axis and being arranged on the lower edge of the wedge surface, the cutting edge extending radially from a point on the core tube axis to the maximum outer circumference of the device.

7. A device as defined by claim 6, wherein the wedge surface is helical.

8. A device as defined by claim 6, wherein a conveying spiral is provided on said core tube, and a part of the cutting edge passes into the conveying spiral.

9. A device as defined by claim 6, wherein cutting teeth are arranged on the cutting edge.

10. A device as defined by claim 6, wherein the lower edge of the wedge surface and/or the lower end face of the core tube is helically chamfered and at least one vertical cutting tooth is located thereon.

11. A device as defined by claim 6, wherein the cutting edge and wedge surface intersect on the core tube axis.

12. A device as defined by claim 6, wherein the lower edge of the wedge surface and the lower end face of the core tube in combination form a spiral.

13. A device as defined by claim 8, wherein the cutting edge extends to the maximum outer circumference of the conveying spiral.

14. A device as defined by claim 8, wherein the core tube jacket has a chamfer at its lower end defined by the free leading edge of the wedge surface and the configuration of a segment of the conveying spiral.

15. A device as recited in claim 14, wherein the chamfer is further defined by a vertical tooth on the core tube jacket.

* * * * *